US010591157B1

(12) United States Patent
Frost

(10) Patent No.: US 10,591,157 B1
(45) Date of Patent: Mar. 17, 2020

(54) METHOD OF CONVERTING A BURNER WITH A DUAL USE POT TO SINGLE FLOW

(71) Applicant: Timothy L. Frost, Chattanooga, TN (US)

(72) Inventor: Timothy L. Frost, Chattanooga, TN (US)

(73) Assignee: Burner Systems International, Inc., Chattanooga, TN (US)

( * ) Notice: Subject to any disclaimer, the term of this patent is extended or adjusted under 35 U.S.C. 154(b) by 151 days.

(21) Appl. No.: 16/016,764

(22) Filed: Jun. 25, 2018

Related U.S. Application Data

(62) Division of application No. 15/265,195, filed on Sep. 14, 2016, now abandoned.

(60) Provisional application No. 62/218,202, filed on Sep. 14, 2015.

(51) Int. Cl.
*F23D 14/20* (2006.01)

(52) U.S. Cl.
CPC ..... *F23D 14/20* (2013.01); *F23D 2203/007* (2013.01)

(58) Field of Classification Search
CPC ..... F23D 14/06; F23D 14/62; F23D 14/64; F23D 2213/00; F23D 2700/025; F23D 2900/14062; F23D 2900/14063
USPC ..... 126/39 R, 39 E; 126/41 A, 41 R, 41 B, 126/41 D, 39 B, 39 C, 39 H, 39 N, 39 J, 126/39 L; 431/216, 354, 278–285
See application file for complete search history.

(56) References Cited

U.S. PATENT DOCUMENTS 4,932,392 A * 6/1990 Home ..... F24C 3/087 126/39 E
5,842,849 A * 12/1998 Huang ..... F23D 14/06 431/284
2001/0010897 A1* 8/2001 Dane ..... F23D 14/065 431/266
2009/0047611 A1* 2/2009 Armanni ..... F23D 14/065 431/284
2014/0196713 A1* 7/2014 Cadima ..... F23D 14/045 126/41 R

* cited by examiner

*Primary Examiner* — Vivek K Shirsat
*Assistant Examiner* — Rabeeul I Zuberi
(74) *Attorney, Agent, or Firm* — Stephen J. Stark; Miller & Martin PLLC

(57) ABSTRACT

A burner has a dual use pot whereby the pot can be machined to provide for single flow control to inner and outer flame rings (directly related to each other) as a single flow configuration or maintained in a dual flow configuration whereby a user can separately control flow to inner and outer flame rings (independently related to one another). A lateral passage is fed from an inlet to feed outer flames while a transverse passage possibly elevationally displaced from the transverse passage for some embodiments can feed the inner ring. The lateral and transverse passages are joined to be in fluid communication through the method taught herein.

20 Claims, 2 Drawing Sheets

METHOD OF CONVERTING A BURNER WITH A DUAL USE POT TO SINGLE FLOW

CLAIM OF PRIORITY

This application is a divisional application of U.S. patent application Ser. No. 15/265,195 filed Sep. 14, 2016, which, in turn, claims priority U.S. Provisional Application No. 62/218,202 filed Sep. 14, 2015, which is incorporated herein by reference in its entirety.

FIELD OF THE INVENTION

The present invention relates to a pot and burner construction for use with stove such as stove burners in which a single pot casting is provided which can either be machined to cooperate with a single gas inlet to provide two flame rings in a dependent manner or alternatively with dual gas inlets which can be used to separately control dual flame rings independently relative to one another.

BACKGROUND OF THE INVENTION

The applicant has been making burners and burner pots for stoves for years. Traditionally, each particular pot would have its own casting. A single gas inlet would have one casting and a dual control pot would have a separate casting. Castings can be relatively expensive for tooling.

Accordingly, a need exists which is perceived to provide an improved casting over prior art techniques.

SUMMARY OF THE INVENTION

Accordingly, it is a present object of many embodiments of the present invention to provide a single pot casting which can be utilized with either single fuel inlet burner constructions through machining the pot in a first way to provide two or more flame rings with fuel simultaneously or alternatively machining the same pot in a separate way to be used as a dual inlet, separately controllable dual set of flame rings such as to provide a dual ring burner with separate interior and exterior flame fuel controls.

It is another object of many embodiments to provide an improved burner pot for use with burners.

It is another object of many embodiments of the present invention to provide an improved method of manufacturing a single burner pot casting which can then be machined in one of at least two ways. A first machining option would allow an inner flame ring to be controlled separately or independently relative to an outer flame ring. Alternatively, a second machining step could be performed so that the fuel flow to the inner flame ring would be directly coupled to fuel flow to the outer ring through the use of a single fuel inlet controlling both flame rings of the burner.

Accordingly, in accordance with a presently preferred embodiment of the present invention, a burner is provided. The burner has a pot which is preferably a top air pot of cast construction. An air flow is received by the burner preferably from above the stove and not internal to a stove and/or from under the burner. The pot is preferably provided with two channels, one which extends laterally across at least substantially along a diameter of the pot and a separate channel extending angularly thereto, such as perpendicularly thereto, in a longitudinal and/or transverse manner along a radian of the burner preferably separate from the lateral channel.

The lateral channel can be machined substantially along its length with a fuel or gas inlet at any end and a lateral passage provided internal thereto for a dual fuel inlet construction. Two downwardly drilled passages can intersect therewith to provide communication from a fuel source through the fuel inlet, the lateral passage, the downward passages and at least one, if not two orifices, to mix with air and then proceed out outwardly disposed flame orifices in the outer flame ring and thus provide fuel from a supply gas to the outer burner ring.

The lateral passage is preferably drilled at a depth in the lateral channel spaced from a depth of a separate transverse passage for a first option so that when a transverse channel is machined into the casting to provide the transverse passage and a downward passage is drilled thereinto, the fuel passages do not intersect within the burner. The transverse passage could terminate at a substantial center of the pot (but preferably not directly under the lateral passage) and then potentially supply a center or inner flame ring through a burner head and an inner flame ring after extending upwardly to a separate orifice. Machining in this way allows for dual control of the inner and outer flame rings through two separate fuel inlets: one fuel inlet connected to the lateral passage, and another fuel inlet connected to the transverse passage.

Alternatively, some uses of this pot could prescribe or prefer a single fuel inlet. Gas could be provided to both an inner and outer burner in a dependent or simultaneous manner from the single fuel inlet. Controlling both an inner and an outer flame ring could be done with a single control at the same time in such a construction. In the single inlet burner, there is no separate control for a center flame ring or outer flame ring as their operation would be directly related to one another. In such a method, the lateral channel can be machined. Instead of just drilling the outer two downward passages to connect thereto, a center passage could also be downwardly machined thereinto as well so that not only is the outer ring fed through orifices to the outer flame ring of the burner head, but also the inner flame ring can be simultaneously fed by the center downward passage.

None of the burner manufacturers are known to provide a single pot which can be selectively machined in one of two different ways to either provide for a single gas inlet and gas flow control to control both the outer and the inner flame ring simultaneously and dependently, or alternatively, a separate machining step could be performed with the same pot in which a first or lateral passage can be formed for supplying fuel to the outer ring and a second passage elevationally spaced from the first passage and machined so as to not intersect therewith with a separate supply passage being machined to provide to an inner flame ring therefrom so as to have separately controllable fuel supplies to the inner and outer flame rings.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
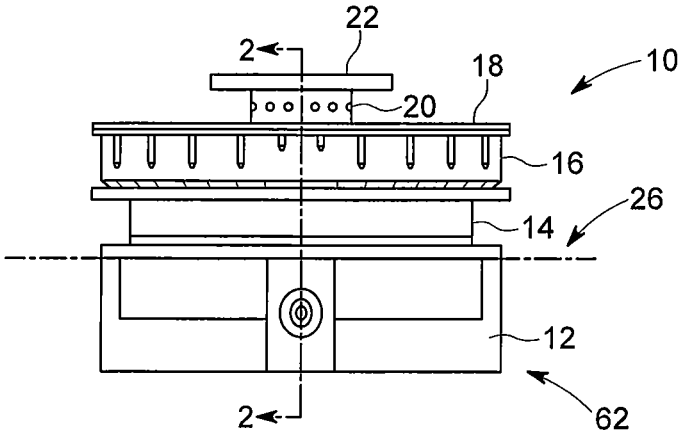
FIG. 1 is a front plan view of the presently preferred embodiment of a burner with a pot constructed in accordance with the presently preferred embodiment of the present invention.

FIG. 1 shows the burner 10 of the presently preferred embodiment of the present invention. Burner 10 has a pot 12. The pot 12 connects to a burner base 14 which usually rests on top of the burner pot 12. Atop the burner base 14 is a first or outer flame ring 16 which preferably has a first cap 18 thereon top. Also connected internal to the first outer flame ring 16 is an inner flame ring 20 with second cap 22. Inner flame ring 20 may rest atop or connect to insert or center support 24 which will be explained in further detail of FIG. 2 below which may or may not be a part of the burner base 14.

The burner pot 12 is shown resting relative to an upper surface 26 of a stove which would be understood by those of ordinary skill in the art. This construction is a top fed burner pot 12 meaning that air flow as utilized by the burner 10 is received from above the upper surface 26 of the stove and not from thereunder as some other burner constructions are. This way, opening and shutting of cabinets or other components below the upper surface 26 have absolutely no effect on the performance of the burner 10. Similar pot constructions could accommodate burners fed from below using the technology disclosed herein.

Figure 2:
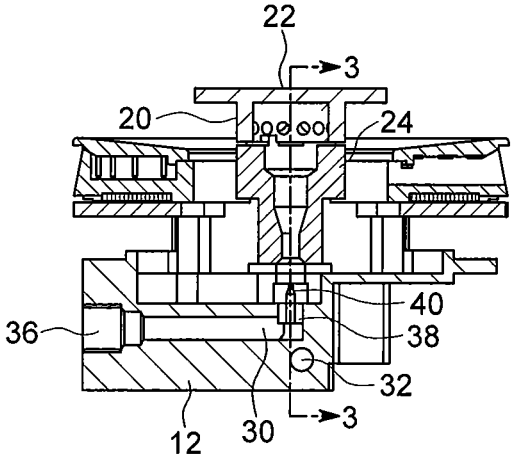
FIG. 2 is a cross sectional view taken along the line 2-2 of FIG. 1.
Figure 3A:
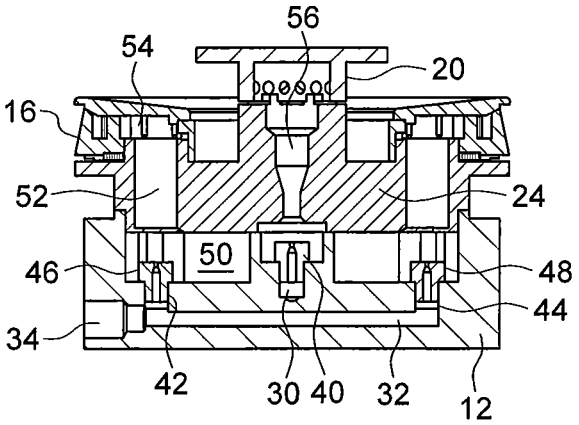
FIG. 3*a* is a cross sectional view taken along the line 3-3 of FIG. 2, the first presently preferred embodiment of the present invention showing dual flow control as is shown also with FIG. 2.

FIGS. 1, 2 and 3*a* show a first presently preferred embodiment of the present invention of a burner construction in the form of a dual inlet, dual control system for the pot 12.

Specifically, FIG. 2 shows a first transverse passage 30 machined into the pot 12. The transverse channel 30 is not shown not intersecting and not in fluid communication with a lateral channel 32 which is also machined into the burner pot 12 within the pot 12.

As can be seen from the reference to FIGS. 2 and 3, the transverse passage 30 is not in fluid communication with the lateral channel 32 within the burner pot 12. Specifically, a first gas supply can be directed into first inlet 34 to provide fuel to the lateral passage 32 and a second gas supply may provide fuel to a second gas inlet 36 to provide fuel to the transverse passage 30. Intersecting the transverse passage 30 a downwardly directed passage 38 is then machined. Downwardly directed passage 38 is shown with an inserted orifice 40. Fuel from the orifice 40 is upwardly directed through insert 24 and then outwardly directed through inner flame ring 20 which may have separate or integral cap 22 thereon.

The inner flame ring 20 is shown being internal to an outer flame ring 16 through which insert 24 may then pass therethrough such as is shown in FIG. 2 and elsewhere. Insert 24 may be formed with outer flame ring 24 and/or burner 14 base for other embodiments. The lateral passage 32 is shown being connected to at least one of first and second downwardly directed passages 42 and 44 which are also is shown with orifices 46,48 inserted therein which provide gas into chambers 50 which is where the air/gas mixture mixes and then proceeds up outward shafts 52 to the outer flame ring 16 through flame slots 54. The flame slots 54 of outer flame ring 16 are not in fluid communication internal to the burner 10 with the inner flame ring 20 which receives gas from the internal orifice 40 mixes with the air therein and directed up insert 24 such as through channel 56 to the inner flame ring 20. Other burner constructions could be provided with the burner pot 12 as shown and described herein.

Figure 3B:
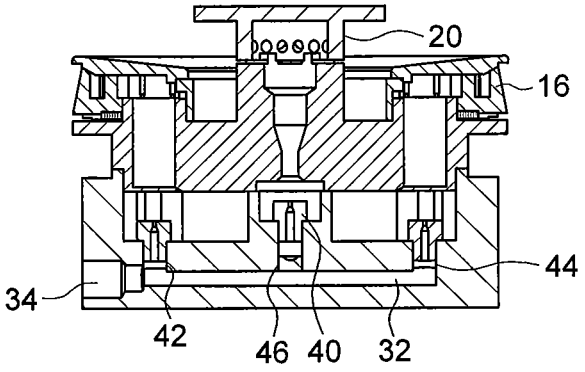
FIG. 3*b* is a first alternatively preferred embodiment of the present invention in which the transverse passage shown in FIG. 2 is not drilled but instead a center top is provided into the lateral passage for a single fuel inlet to provide all three taps.
Figure 4:
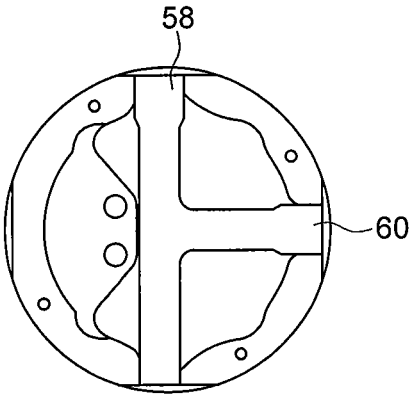
FIG. 4 is a bottom plan view of the pot shown in FIG. 1-3.

The above description describes a dual gas flow dual control method of machining the burner pot 12 which is one method of machining the burner pot 12 of the presently preferred embodiment of the present invention. That exact same burner pot 12 could be machined differently as is shown in FIG. 3*b* so that lateral passage 32 could not only have at least one of first and second downwardly extending channels 42 and/or 44 machined therein but also third downwardly extending channel 45 could be machined to comprise lateral passage 32. Downwardly extending channel 45 could supply the center orifice 40 while downwardly extending channel(s) 42,44 could supply at least one of outer orifices 46,48 and thus outer flame rig 16 and thus only a single fuel inlet 34 needs to be provided. In such a construction, the inner flame ring 20 is provided with fuel in direct proportionality to the gas flow through the outer flame ring 16 as would be understood by those of ordinary skill in the art. The transverse passage 30 may not even be machined in such a configuration much less a second fuel inlet 36 as shown in FIG. 2.

This way, a single pot 12 can be utilized to provide one of either a single control, single inlet burner pot 12 for a burner 10 or a dual flow dual control burner pot 12 for burner 10 depending on the desires of the customers of the burner 10. Accordingly, a single casting can be made for burner pot 12 and then, depending on its particular intended use, the machining step could then be accommodated in one of two different manners to provide the ability to be used either as a single fuel inlet single control valve or a dual inlet dual control valve as would be understood by those of ordinary skill in the art as explained above.

It is important to remember that when machining the single flow control, a single passage such as lateral passage 32 could be utilized to provide the fuel to at least an outer ring 16 as well as to the inner flame ring 20 in a directly proportional manner such as by having at least one outer downward passage 42 and/or 44 communicate with lateral passage 32 as well as the central downward passage 45 communicate with the lateral passage 32 as well. Plug 47 in inlet 36 of lateral passage 32 may seal off the lateral passage 32 for such construction as well unless inlet 36 is connected to the same control valve external to the burner 10 as inlet 34.

Meanwhile, to provide the pot 12 in a dual flow dual control channel, it is important that a separate the transverse passage 30 from the lateral passage 32, by machining the pot 12 so that in a separate flow path from the lateral passage 32 provides fuel from a first fuel inlet 34 to at least one of the downwardly extending channels 42,44 to supply the outer ring 16 with fuel. While the transverse passage 32 can be utilized to provide fuel to the central downward passage 30, from a separate inlet 36. Thus, the inner flame ring 20 can be controlled independently of fuel flow through the lateral passage 32 to the outer ring 16. This way the two separate fuel inlets 34 and 36 could be independently controlled through separate valves coupled to the respective inlets 34,36 so as to be able to separately and independently control flames at the inner flame ring 20 relative to the outer flame ring 16.

The pot 12 preferably has a construction whereby the lateral channel 58 can be machined to provide a lateral passage 32 while the transverse channel 30 can be machined to provide a transverse channel 60. It may be that the transverse channel 60 and the lateral channel 58 (and passages 30,36) are perpendicular to one another as shown. However, the angle between the passages (30,32) and channels (60,58) may be provided in other angular relationships for other embodiments. Furthermore, the lateral channel 58 and the transverse channel 60 are shown extending to meet along a common plane 62 as is shown in FIG. 1 and others. However, this may not be the case for all embodiments. It is merely desirable for many embodiments that the lateral channel 58 and the transverse channel 60 be provided so that when the lateral passage 32 is machined relative to the transverse passage 30 that they not intersect within their respective channel within either of the channels 58,60 or elsewhere within the pot 12 for at least the preferred embodiment (for dual flow and/or dual control option). Furthermore, the respective downward channels 42,44 and 38 preferably are not in fluid communication when provided in the dual control, dual inlet 34,36 construction.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of converting a burner pot from a dual flow option to a single flow comprising:

providing an outer flame ring and an inner flame ring;

providing a burner pot directing a gas air mixture to each of the outer and inner flame rings, said burner pot having:

a lateral channel through the pot proceeding from a first inlet to at least a first downwardly directed passage, said first downwardly directed passage having a first orifice connected thereto, whereby gas is directed from an external source through the first inlet and through the lateral channel and proceeds upwardly through the first downwardly directed passage and out the first orifice to be mixed with air and then directed out the outer flame ring as an outer ring of flame from the burner when ignited; and a transverse channel through the pot proceeding from an inlet to at least a second downwardly directed passage, said second downwardly directed passage having a second orifice connected thereto, whereby gas proceeds from the lateral channel upwardly through the second downwardly directed passage and out the second orifice to be mixed with air and then directed out the inner flame ring as an inner ring of flame from the burner when ignited, wherein the lateral channel is elevationally spaced from the transverse channel internal to the burner pot, and the lateral channel is angled relative to the internal channel, and said transverse channel is not initially in fluid communication with the lateral channel internal to the burner pot whereby a dual flow configuration would be provided if installed, and control of gas through the first inlet would independently control gas flow through the outer flame while control of gas through the second inlet would independently control gas flow through the inner flame; and then machining the burner pot to connect the lateral and transverse channels with a third downwardly directed channel intersecting both the transverse channel and the lateral channel internal to the burner pot to thereby provided a single flow configuration with the transverse channel and the lateral channel in fluid communication therewith so that control of gas to one of the first inlet and a second inlet to the transverse channel directly affects the flames proceeding from both the inner and the outer flame rings when installed.

2. The method of claim 1 further comprising the step of casting the pot as a cast burner pot.

3. The method of claim 1 further comprising the step of installing the burner in a stove and the pot being a top air pot receiving airflow received above a stove.

4. The method of claim 1 wherein the transverse channel terminates around a center of the pot.

5. The method of claim 1 wherein the lateral channel proceeds along a diameter of the pot.

6. The method of claim 1 wherein the outer flame ring has an outer flame ring cap on top thereof.

7. The method of claim 1 wherein the inner flame ring has an inner flame ring cap on top thereof.

8. The method of claim 1 wherein the inner flame ring is disposed elevationally above the outer flame ring.

9. The method of claim 1 wherein the lateral channel communicates with a third downwardly directed channel having a third orifice.

10. The method of claim 1 wherein the lateral channel is perpendicular to the transverse channel.

11. A method of converting a dual flow burner to a single flow burner comprising the steps of:

providing an outer flame ring and an inner flame ring;

casting a cast burner pot configured to direct a gas air mixture to each of the outer and inner flame rings, said burner pot having:

a lateral channel machined through the pot proceeding from a first inlet to at least a first downwardly directed passage, said first downwardly directed passage having a first orifice connected thereto, whereby gas is directed from an external source through the first inlet and through the lateral channel and proceeds upwardly through the first downwardly directed passage and out the first orifice to be mixed with air and then directed out the outer flame ring as an outer ring of flame from the burner when ignited; and a second downwardly directed passage having a second orifice connected thereto, whereby gas proceeds upwardly through the second downwardly directed passage and out the second orifice to be mixed with air and then directed out the inner flame ring as an inner ring of flame from the burner when ignited;

wherein the burner pot is selectively machined after being cast to initially provide a dual flow configuration wherein the lateral channel and a transverse channel in fluid communication with the second downwardly directed passage and connected to a second inlet are not in fluid communication with one another internal to the burner pot, and control of gas through the first inlet independently controls gas flow through the outer flame while control of gas through the second inlet independently controls gas flow through the inner flame when in operation; and then machining the burner pot to provide a single flow configuration wherein the first downwardly directed channel and the second downwardly directed channel are in fluid communication within the burner pot so that control of gas to the lateral channel directly affects the flames proceeding from both the inner and the outer flame rings.

12. The method of claim 11 wherein after the machining step, when in the single flow configuration, the transverse channel is in fluid communication with the lateral channel internal to the pot.

13. The method of claim 11 further comprising the step of installing the burning in a stove and the pot is a top air pot having airflow received above a stove.

14. The method of claim 11 wherein the transverse channel terminates around a center of the pot.

15. The method of claim 11 wherein the lateral channel proceeds along a diameter of the pot.

16. The method of claim 11 wherein the outer flame ring has an outer flame ring cap on top thereof.

17. The method of claim 11 wherein the inner flame ring has an inner flame ring cap on top thereof.

18. The method of claim 11 wherein the inner flame ring is disposed elevationally above the outer flame ring.

19. The method of claim 11 wherein the lateral channel communicates with a third downwardly directed channel having a third orifice.

20. The method of claim 11 further comprising the step of machining the lateral channel perpendicular to the transverse channel.

* * * * *